United States Patent [19]

Lin et al.

[11] 4,185,194

[45] Jan. 22, 1980

[54] CLOSED CYCLE GAS HANDLING SYSTEM

[75] Inventors: Shao-Chi Lin, La Jolla; Steve A. Wright, Playa del Rey, both of Calif.

[73] Assignee: Xonics, Inc., Van Nuys, Calif.

[21] Appl. No.: 875,990

[22] Filed: Feb. 8, 1978

[51] Int. Cl.² ..... G09G 13/00; G09G 15/00

[52] U.S. Cl. ..... 250/315.1; 250/323

[58] Field of Search ..... 250/315 A, 315, 323

[56] References Cited

U.S. PATENT DOCUMENTS

| | | | |
|---|---|---|---|
| 3,828,191 | 8/1974 | Eseke et al. | 250/315 A |
| 3,836,777 | 9/1974 | Lewis et al. | 250/315 A |

*Primary Examiner*—Craig E. Church

*Assistant Examiner*—Thomas P. O'Hare

*Attorney, Agent, or Firm*—Harris, Kern, Wallen & Tinslet

[57] ABSTRACT

Process and apparatus for providing an imaging gas under pressure to the imaging chamber of an electron radiographic system. After closing the imaging chamber, air is flushed out by introducing a condensable gas such as a Freon. The Freon is then flushed out by a charge of the imaging gas, such as xenon and krypton. The exhausted air-Freon mixture is collected and pressurized to condense and separate out the Freon from the air. The liquid Freon is then expanded into a gas and used for a subsequent flushing step. Similarly, the exhausted Freon-zenon mixture is retained and pressurized to liquify and separate the Freon from the xenon. The liquid Freon is expanded to a gas and used for a subsequent flushing operation and the xenon is used for a subsequent charge into the imaging chamber. After an exposure, the imaging gas is flushed out with Freon and the chamber may then be opened. Alternatively, the Freon may be flushed out by air prior to opening, with this Freon-air exhaust being retained and recycled so that there is substantially no loss of imaging gas or Freon.

4 Claims, 1 Drawing Figure

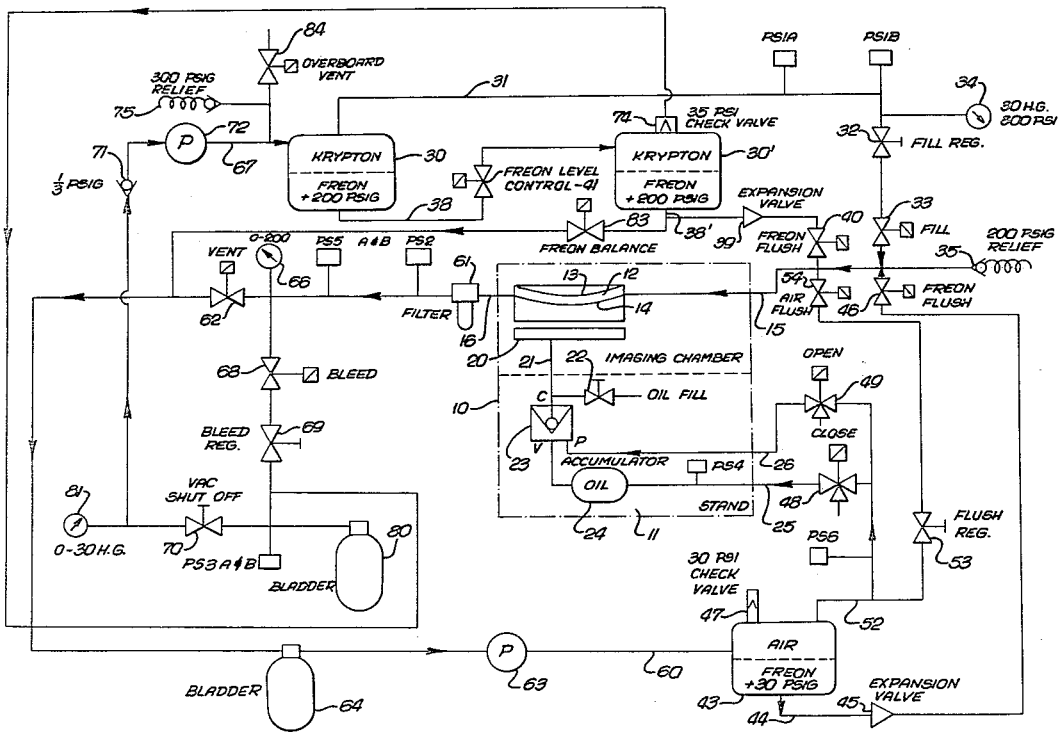

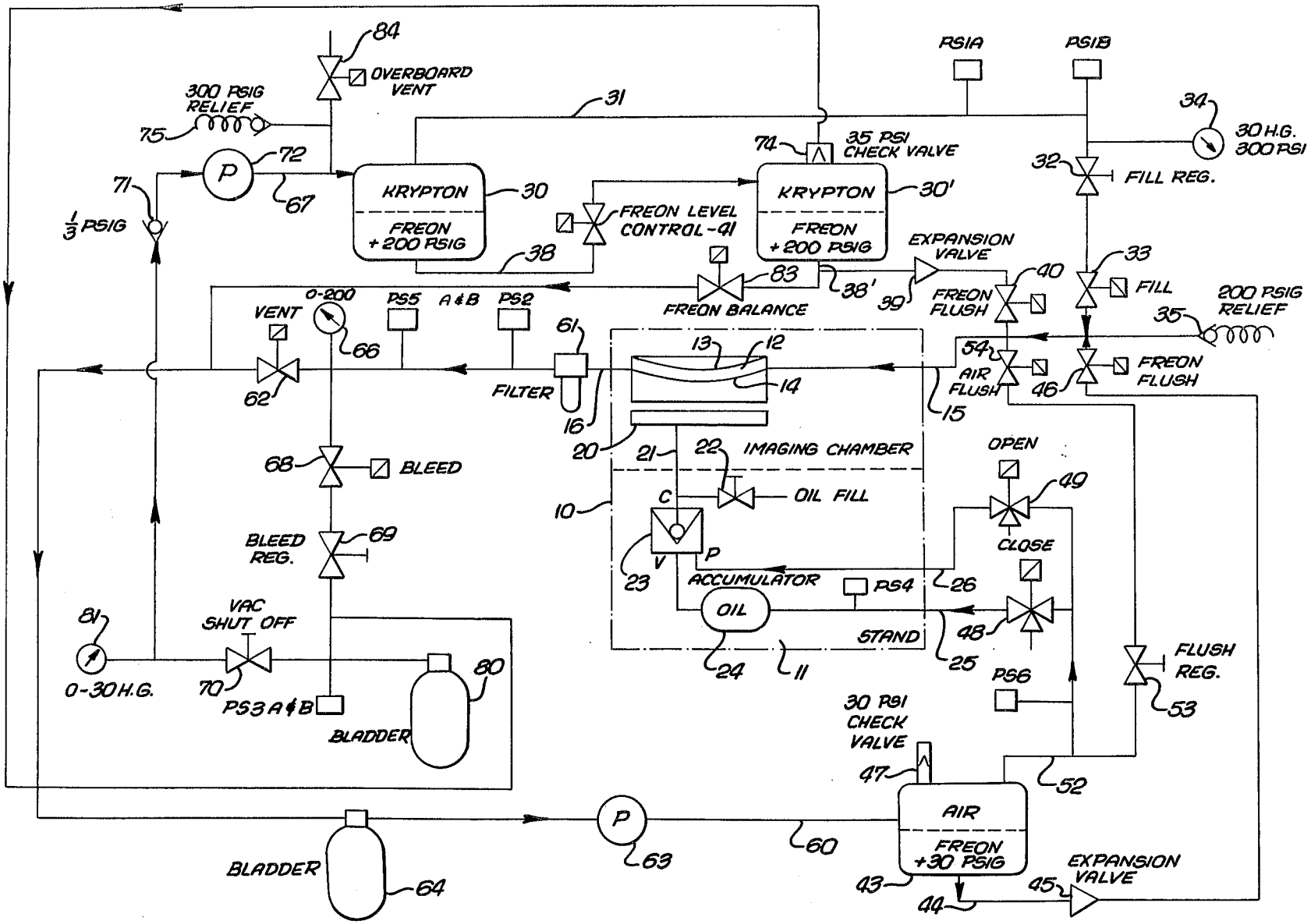
30 H.G.
300 PSI
34
FILL REG.
PS1B
PS1A
32
33
FILL
200 PSIG
RELIEF
35
FREON
FLUSH
46
FLUSH
REG.
53
EXPANSION
VALVE
45
52
40
EXPANSION
VALVE
39
FREON
FLUSH
54
AIR
FLUSH
15
OPEN
49
CLOSE
48
PS6
26
25
AIR
FREON
+30 PSIG
44
43
30 PSI
CHECK
VALVE
47
30'
35 PSI
CHECK VALVE
KRYPTON
FREON
+200 PSIG
38'
74
83
FREON BALANCE
12
14
13
IMAGING CHAMBER
OIL FILL
22
21
20
16
10
PS4
STAND
ACCUMULATOR
OIL
24
11
P
C
V
23
60
63
P
FREON LEVEL
CONTROL-41
31
61
FILTER
30
38
KRYPTON
FREON
+200 PSIG
PS2
A & B
PS5
84
OVERBOARD
VENT
66
0-200
VENT
62
BLEED
68
69
BLEED
REG.
80
BLADDER
PS3 A & B
VAC
SHUT OFF
70
64
BLADDER
72
67
300 PSIG
RELIEF
75
71
1/3 PSIG
81
0-30 H.G.

CLOSED CYCLE GAS HANDLING SYSTEM

BACKGROUND OF THE INVENTION

This invention relates to electron radiography and in particular, to a new and improved method and apparatus for handling the imaging gas in the imaging chamber of an electron radiographic system.

In a typical electron radiographic system, an imaging gas of high atomic number such as xenon or krypton, is maintained under several atmospheres pressure between electrodes in an imaging chamber. The imaging chamber is opened after each exposure to remove the exposed receptor sheet and insert a new receptor sheet. The gas which was in the imaging chamber at the time of opening is lost, and after closing, the imaging chamber is filled with atmospheric air at ambient pressure.

The imaging gas is expensive and it is desirable to recover as much of it as possible. Also, the imaging gas which is recovered should be kept pure for subsequent reuse. One gas handling system for an electron radiography imaging chamber is shown in U.S. Pat. No. 3,828,191. In this system, the air is purged from the imaging chamber after closing utilizing carbon dioxide. The carbon dioxide is flushed out by the imaging gas and the imaging chamber is ready for the exposure. After exposure the imaging gas is flushed out with carbon dioxide and this gas mixture is treated to remove the carbon dioxide, typically by use of a lime reaction. Water from this reaction is then absorbed by another chemical. This system requires three expendables, the carbon dioxide, the lime and the water absorbing material.

It is an object of the present invention to provide a new and improved closed cycle gas handling method and apparatus which does not utilize expendables and which does not require servicing for replacement of expendables. Of course, it should be realised that there always may be some loss of gases due to leaks and to errors in operation.

SUMMARY OF THE INVENTION

The process of the invention provides an imaging gas under pressure to an imaging chamber of an electron radiographic system. After the chamber is closed, air is moved from the chamber by introducing a condensable gas. The air and condensable gas mixture is recovered and pressurized to liquify the condensable gas and thereby separate it from the air. The condensable gas is then flushed from the imaging chamber by introducing the imaging gas and the chamber is ready for the exposure. The condensable and imaging gas mixture is recovered and the condensable gas is liquified to separate these two gases. After the exposure, the imaging gas is flushed out by the condensable gas and this gas mixture is captured and pressurized for recycling. The imaging chamber may be opened at this time with a loss of a slight amount of the condensable gas. Alternatively, the condensable gas may by flushed out by air after which the chamber is opened with a loss only of the air. The air and condensable gas mixture is captured and pressurized for recycling.

The apparatus of the invention includes a first container for imaging gas and condensable gas and a first pump for pumping the imaging and condensable gas mixture to the first container. The apparatus also includes a second container for the air or purge gas and the condensable gas and a second pump for pumping the air and condensable gas mixture to the second container. Gas flow paths with control valves are provided for introducing the gases into the imaging chamber and removing gas mixtures from the imaging chamber in the proper sequence. The valve operations may be controlled manually or automatically, as desired.

BRIEF DESCRIPTION OF THE DRAWING

The single FIGURE of the drawing diagrammatically illustrates the imaging chamber of an electron radiographic system and the presently preferred embodiment of the closed cycle gas handling system.

DESCRIPTION OF THE PREFERRED EMBODIMENTS

An imaging chamber 10 and a stand 11 for supporting the imaging chamber are shown diagrammatically in the drawing. The imaging chamber includes a gas gap 12 between an upper electrode 13 and a lower electrode 14. Gas is introduced into the gap through an inlet 15 and gas is removed from the gap through an outlet 16. More detailed information on an imaging chamber and the method of making an electron radiograph is provided in U.S. Pat. No. 3,774,029, which is incorporated herein by reference.

The imaging chamber is opened to remove the exposed receptor sheet and to insert a new receptor sheet. The imaging chamber may be opened and closed manually or automatically or otherwise as desired, and in the embodiment illustrated, a hydraulic opening and closing mechanism as shown in U.S. Pat. No. 4,065,670 is indicated by the block 20. The stand 11 provides hydraulic fluid to the device 20 via line 21 for opening and closing the imaging chamber. An oil fill line with control valve 22, a pilot valve 23, and an accumulator 24 are included in the stand 11. The stand also has an inlet 25 for air for closing the chamber and an inlet 26 for air for opening the chamber. A pressure switch PS4 provides an indication when the chamber is closed.

The gas handling system includes a container 30 for an imaging gas and a condensable gas. The imaging gas typically is xenon or krypton, and krypton is indicated in the drawing. The condensable gas is a gas which is in the gaseous form at ambient temperature and pressure, but which can be liquified by increasing the pressure or by lowering the temperature. For the present application, a gas which can be liquified by elevating the pressure to about 15 to 20 psig is satisfactory. A number of gases are available which meet this criteria, including propane and certain of the Freons. Freon is indicated as the condensable gas in the drawing.

A gas outlet 31 from the container 30 is connected to the imaging chamber inlet 15 through a regulator valve 32 and a solenoid controlled on-off valve 33. Pressure switches PS1A and PS1B may be utilized to provide indications when the pressure of the imaging gas is high and low, respectively. A pressure indicating gauge 34 may also be connected in this line to provide a visual indication of pressure. A pressure relief valve 35 may be connected to the chamber inlet 15.

A single container 30 may be used for separating imaging gas and condensable gas, but it is preferred to use a second container 30' in cascade with the container 30 for improved separation. This reduces loss of the imaging gas due to its solubility in the condensable gas. A liquid outlet 38 from the container 30 is connected to the inlet of the container 30' and a liquid outlet 38' from the container 30′ is connected to the chamber inlet 15 through an expansion valve 39 and an on-off valve 40. A level control valve 41 is provided in the line between the containers.

Another container 43 is charged with a purge gas such as air and a condensable gas such as Freon. The liquid outlet 44 of the container 43 is connected through an expansion valve 45 and an on-off valve 46 to the chamber inlet 15. A check valve 47 is provided on the container 43 as a pressure relief valve. The air from the container 43 may be used to provide control air for the stand 11, through valves 48, 49. Pressure switch PS6 provides an indication when the air pressure is below a predetermined figure. Alternatively, control pressure for the stand may be provided by the condensable gas at the inlet of the container 30, or by a separate source, as desired.

Also, the gas outlet 52 of the container 43 may be connected to the chamber inlet 15 through a regulator valve 53 and an on-off valve 54.

The outlet 16 of the imaging chamber may be connected to the inlet 60 of the container 43 through a filter 61, an on-off valve 62, and a pump 63. A variable volume reservoir such as a bladder 64 may be connected in the line between the valve 62 and the pump 63.

Pressure switches PS2A and B may be connected at the outlet 16 to provide indications when the pressure in the imaging chamber is too high and too low, respectively. Another pressure switch PS5 may be connected at the outlet 16 to provide an indication when the pressure in the imaging chamber is near ambient so that the chamber can be opened. A pressure indicating gauge 66 may also be connected to the outlet 16.

The imaging chamber outlet 16 is connected to the inlet 67 of the container 30 through an on-off valve 68, a regulator valve 69, a shut off valve 70, a check valve 71, and a pump 72. Another variable volume reservoir such as a bladder 80 may be connected in the line between the outlet 16 and the pump 72. Another pressure switch PS3A and B provides an indication of high and low pressure in the line at the bladder 80. A gauge 81 provides an indication of pressure in the inlet to the pump 72. The outlet of a check valve 74 on the container 30′ is connected to the line between the chamber outlet 16 and the pump 72 inlet. Another valve 84 provides for venting the pump outlet, and a relief valve 75 is connected in the pump outlet. The liquid outlet 38′ of container 30′ is connected to the line between the chamber outlet 16 and the pump 63 inlet through a valve 83 to provide for balancing the amount of condensable gas in the two condensable gas systems.

In operation, the imaging chamber is opened, the receptor sheet is removed and a new receptor sheet is inserted, and the chamber is closed, trapping atmospheric air in the gap 12. Valve 46 and valve 62 are opened, with all other on-off valves closed. The liquid condensable gas under pressure in the container 43 is expanded to a gas in expansion valve 45 and flushes the air from the imaging chamber, with the air and condensable gas mixed therewith being recovered via the valve 62, bladder 64 and pump 63. The recovered mixture is pressurized by the pump 63, liquifying the condensable gas, which separates from the air in the container 43.

Valves 46 and 62 are then closed and valves 33 and 68 are opened. The imaging gas under pressure from the container 30′ now flushes the condensable gas out and the imaging chamber gas gap is filled with the imaging gas. The condensable gas with the imaging gas mixed therewith is recovered in bladder 80 and compressed by pump 72 and returned to container 30, with the condensable gas being liquified and separated from the imaging gas. Valves 33 and 68 are closed and the chamber is ready for the exposure.

After the exposure, valves 40 and 68 are opened and liquid condensable gas from the container 30′ is expanded to a gaseous state through valve 39 and flushes the imaging gas from the chamber. The imaging gas and condensable gas mixed therewith is recovered and returned to the container 30 as previously described.

The imaging chamber may now be opened for removal of the receptor sheet, with the condensable gas therein being lost to the atmosphere. Alternatively, valves 54 and 62 may be opened, with air from the container 43 flushing the condensable gas from the imaging chamber, with the condensable gas and air mixed therewith being recovered as previously described. The imaging chamber then contains air which is mixed with the ambient atmosphere when the chamber is opened.

The gas handling system is a closed system which does not expend imaging gas and which in the preferred embodiment does not expend condensable gas. Also, no reaction material is required in the system.

Solenoid controlled on-off valves have been illustrated in the drawing. Of course, all of the valves may be manually operated, but it is preferred to utilize an automatic system controlled by timers, pressure switches and the like, so that the operator has only to initiate imaging chamber closing and exposure. The automatic operation and timing is not a feature of the present invention and hence is not described herein.

We claim:

1. An improved system for supplying and recycling imaging gas to an electron radiographic imaging chamber wherein a successively openable and closable gap is provided between spaced electrodes to receive imaging gas while closed, which gas is thereafter flushed therefrom, said improved system comprising, in combination, a pressurizable reservoir for storing said imaging gas and a condensable gas under sufficient pressure to liquify said condensable gas;

a liquid outlet from said reservoir with cooperating duct and valve means for receiving liquified condensable gas therefrom, vaporizing said gas and supplying same at selected intervals to said gap when said gap is closed so as to flush therefrom any atmospheric air trapped therein;

a pressuriable container having an inlet and cooperating pump and duct means for receiving said condensable gas and any air entrained therewith at selected intervals from said gap and for pressurizing same sufficiently to liquify said condensable gas and thus separate same from said air;

means for returning said condensable gas to said reservoir;

a gas outlet in said reservoir including duct means for supplying imaging gas therefrom to said closed gap so as to flush condensable gas from said gap and fill same with imaging gas;

further pump and duct means for receiving imaging gas and condensable gas from said gap and returning same under sufficient pressure to said reservoir to liquify and separate said condensable gas from said imaging gas; and suitable controls for sequentially supplying condensable gas and imaging gas to said gap and recycling the respective gases for separation and re-use.

2. The system as defined in claim 1 wherein an air outlet and cooperating duct and valve means are provided from said container to said openable and closable gap so as to flush condensable gas therefrom and replace said gas with air before opening said gap.

3. An improved process for alternately supplying imaging gas and a condensable flushing gas to an electron radiographic imaging chamber recovering same therefrom for recycling comprising the steps of closing the imaging chamber;

flushing air from said chamber with said flushing gas and collecting air so flushed in a pressurizable container;

introducing imaging gas into said chamber, thus displacing said flushing gas and collecting same in said pressurizable container;

thereafter flushing imaging gas from said chamber with flushing gas and collecting same in a pressurizable reservoir;

pressurizing the air and flushing gas in said container to condense and liquify said flushing gas for recycling to said reservoir; and pressurizing the imaging gas and flushing gas in said reservoir to condense and liquify said flushing gas for separation from said imaging gas for separate recycling of said gases to said imaging chamber.

4. An improved process for separately supplying air, condensable flushing gas and imaging gas to an electron radiographic imaging chamber and thereafter removing same therefrom and separating out the respective gases and air for subsequent recycling, which comprises the steps of closing the imaging chamber for radiographic imaging;

injecting flushing gas into said chamber to flush air with said gas therefrom;

injecting imaging gas into said chamber, thus expelling flushing gas along with some imaging gas therefrom;

injecting vaporized flushing gas into said chamber to flush imaging gas and some flushing gas therefrom;

injecting air into said chamber to remove flushing gas and some air therefrom;

collecting combinations of air and flushing gas in a pressurizable container under sufficient pressure to condense and liquify said flushing gas to separate same from said air;

collecting combinations of imaging gas and flushing gas from said chamber in a pressurizable reservoir under sufficient pressure to condense and liquify said flushing gas to separate same from said imaging gas; and thereafter recycling said air, flushing gas and imaging gas to said chamber as aforesaid.

* * * * *